US006047519A

United States Patent [19]

Bagn

[11] Patent Number: 6,047,519

[45] Date of Patent: Apr. 11, 2000

[54] ALL-CLIMATE FLEXIBLE BUILDING CONSTRUCTION METHOD

[76] Inventor: Bjorn B. Bagn, 631 Brandy Hill Rd., Torrington, Conn. 06790

[21] Appl. No.: 08/979,719

[22] Filed: Nov. 28, 1997

[51] Int. Cl.[7] ..... E04B 2/00; E04B 1/00

[52] U.S. Cl. ..... 52/745.19; 52/656.1; 52/745.2; 52/745.13; 52/745.09

[58] Field of Search ..... 52/241, 656.1, 52/745.1, 745.2, 745.19, 745.13, 745.09

[56] References Cited

U.S. PATENT DOCUMENTS

| | | | |
|---|---|---|---|
| 2,986,193 | 5/1961 | Howell | 52/745.13 X |
| 3,034,609 | 5/1962 | Young | 52/241 |
| 3,940,900 | 3/1976 | Russo | 52/656.1 |
| 4,147,004 | 4/1979 | Day et al. | 52/745.19 X |
| 4,558,552 | 12/1985 | Reitter | 52/745.19 |
| 5,417,023 | 5/1995 | Mandish | 52/656.1 X |
| 5,579,621 | 12/1996 | Mandish | 52/656.1 X |
| 5,660,012 | 8/1997 | Knudson | 52/656.1 X |
| 5,749,187 | 5/1998 | Umehara et al. | 52/241 |
| 5,765,330 | 6/1998 | Richard | 52/745.19 X |
| 5,819,498 | 10/1998 | Geraci | 52/745.2 X |

*Primary Examiner*—Carl D. Friedman
*Assistant Examiner*—Timothy B. Kang

[57] ABSTRACT

This invention relates to methods and processes which may be used to construct modular buildings, floors, wall, partitions and roofs. A metal or plastic framework is assembled and covered with an absorbent material onto which a polymer substrate is applied. A variety of exterior finish materials may be attached to the substrate. Utility services are modularly installed in each section prior to the wall void being foamed for added strength. An interior finish surface is then applied to the modular section. The modular sections are transported to the job site for final assembly and interconnection.

18 Claims, 8 Drawing Sheets

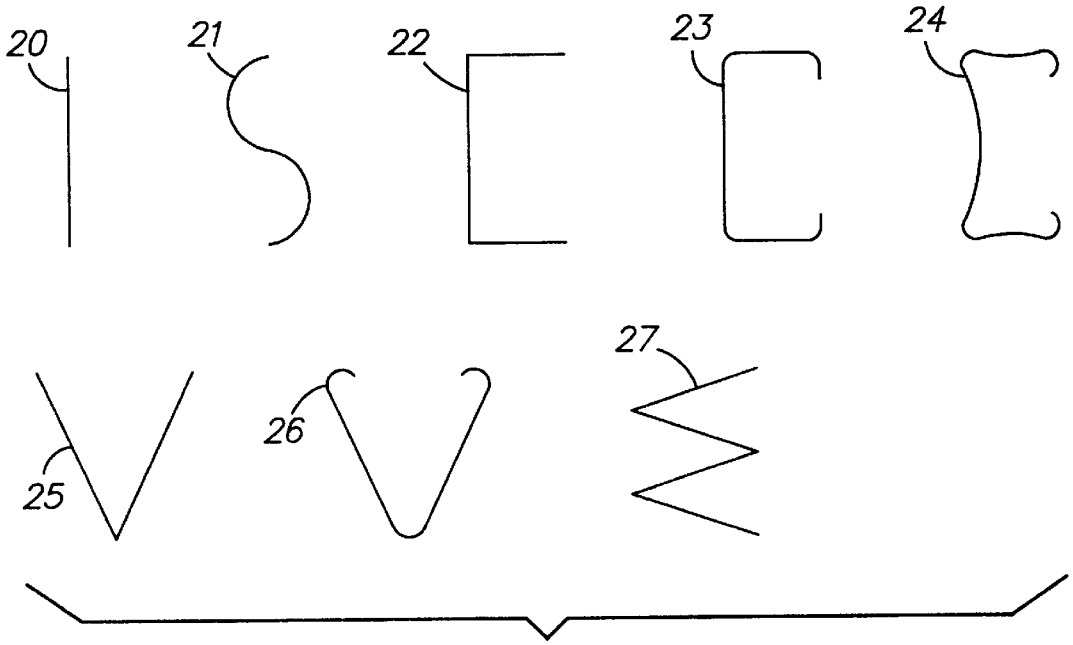
FIG. 1D
FIG. 2A
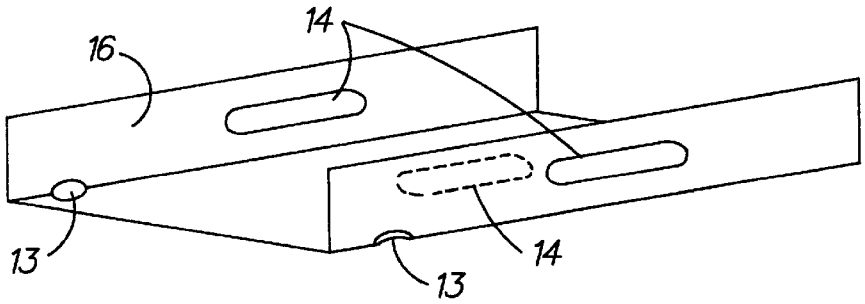

ALL-CLIMATE FLEXIBLE BUILDING CONSTRUCTION METHOD

FIELD OF THE INVENTION

The invention relates generally to methods and processes for constructing buildings, and more specifically to a method and process to form a structure which has superior material strength and design flexibility over conventional techniques.

DESCRIPTION OF THE PRIOR ART

Conventional construction consists of wood stick frame buildings, usually built on site. In many climates wood is either very expensive or scarce and or it is easily attacked by the elements of nature providing a very short and costly life cycle problem. Also, conventional wood frame building techniques do not have any inherent ability to withstand earthquakes or hurricanes.

Accordingly, it can be seen that there exists a need for a simple and effective method and process adapted for constructing buildings which addresses local material supplies, earthquake and hurricane survivability, and cost effective building problems.

SUMMARY OF THE INVENTION

The present invention overcomes the disadvantages of the prior art by providing a method and process of constructing buildings through the use of superior materials and an assembly process which inherently allows greater structural elasticity than conventional building techniques.

It is an object of the invention to provide a method and process of building construction which is highly efficient in terms of material waste, adaptable to varying climates and socio-economical cultures, and efficient in costs so as to accommodate various widely varying building requirements.

It is another object of the invention to provide a method and process which may be used anywhere in the world, and particularly in those areas where there is tremendous need for a low cost, natural disaster and environmentally resistant building solution.

The invention will be more clearly understood upon reading the following detailed description of preferred embodiments thereof in conjunction with the accompanying drawings.

BRIEF DESCRIPTION OF THE DRAWINGS

FIG. 1D is a cross-sectional view of various shaped channels.

FIG. 2A is a perspective view of a channel member with various holes.

FIG. 5 is a side elevation view of a wall section.

DETAILED DESCRIPTION OF THE PREFERRED EMBODIMENTS

Figure 1A:
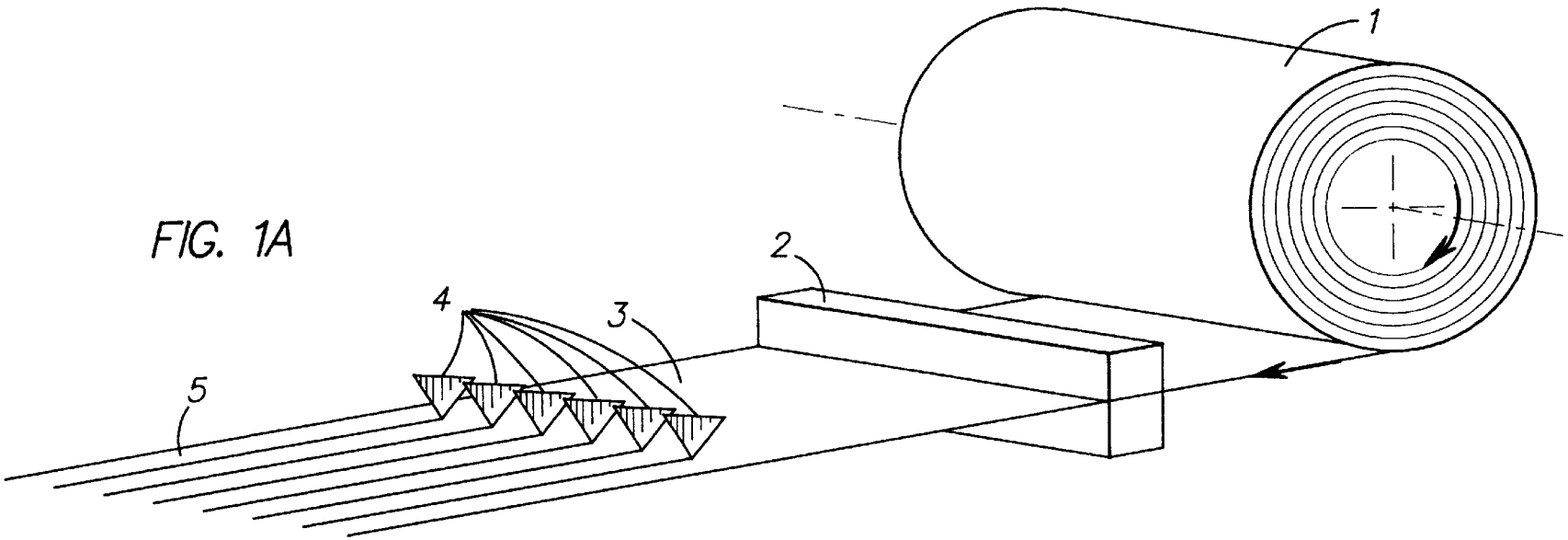
FIG. 1A is a perspective view of the sheet straightening and strip cutting process.

Referring to FIG. 1A, a coil 1 of sheet steel or alumintim is drawn through a sheet straightener 2, so as to remove any curling of the metal due to being stored in the coil 1. The sheet 3 is then drawn through sheet slitters 4 forming strips 5 of metal of a predetermined width.

Figure 1B:
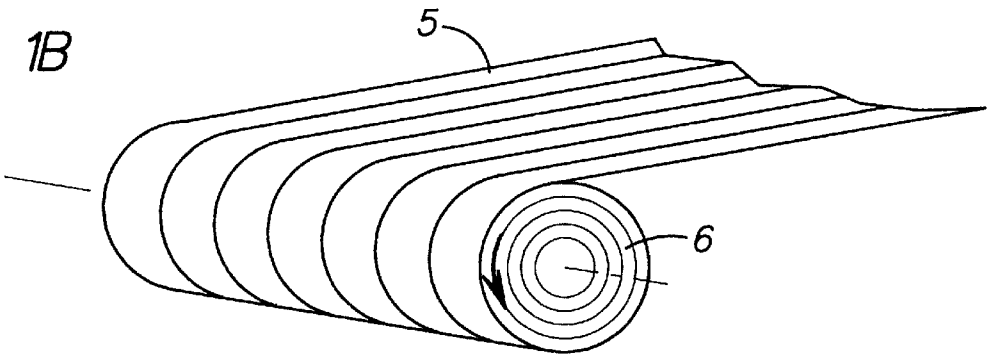
FIG. 1B is a perspective view of the strip recoiling process.

Referring to FIG. 1B, the strips 5 are recoiled into strip coils 6 for further processing.

Figure 1C:
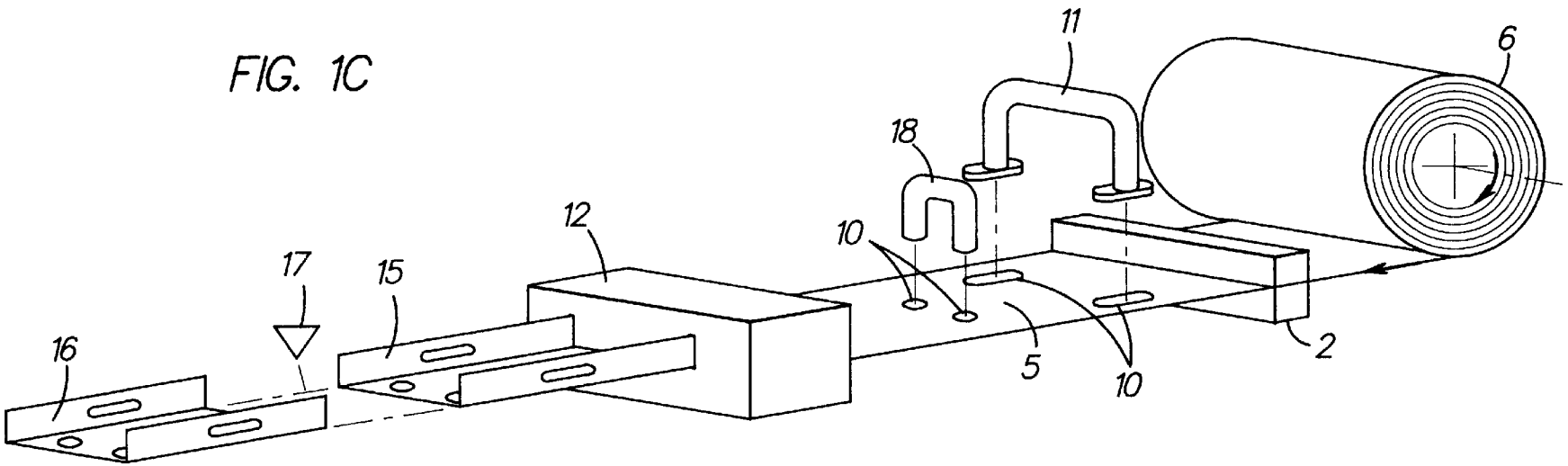
FIG. 1C is a perspective view of the strip to channel forming process.

Referring to FIG. 1C, each strip coil 6 is individually processed, first by being drawn through a sheet straightener 2. Next various sized and shaped holes 10 are punched into the strip 5 by two hole punchers 11 and 18 at repeating intervals so that each finished channel 16 will have a set of holes 10.

The strip 5 is then drawn through a roll former 12 which bends the strip 5 into a desired cross-sectional shape forming a continuous channel 15. The continuous channel 15 is then processed through a cutter 17 which cuts the continuous channel 15 into desired length channels 16.

Referring to FIG. 1D, there are many cross-sectional shaped channels 15 that the strip 5 may be formed into. The geometric cross-sectional design is an important factor in determining the strength and survivability of the channel 16 due to compression loads and bending moments. The selection of the channel 16 design will depend on many factors including strength required, materials used, and cost requirements. In FIG. 1D, the following channel 16 cross-sections are shown: I-channel 20, S-channel 21, U-channel 22, C-channel 23, smooth C-channeled 24, V-channel 25, smooth V-channel 26, and W-channel 27.

Figure 9:
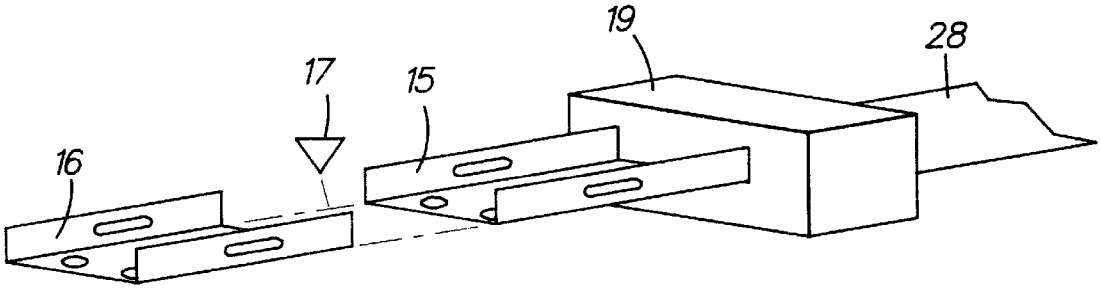
FIG. 9 is a view of the strip cutting process.

FIG. 9 shown how in lieu of roll forming, aluminum 28 may be extruded into the desired shaped channel 16 for greater strength.

These channels 16 may also be fabricated from high strength laminates, composites and or reinforced plastics pre-formed to architectural and structural design requirements.

Referring to FIG. 2A, a typical channel 16 is shown with drain holes 13 and utility/attachment holes 14. Larger holes 14 cut into the side-walls of these channels 16 will facilitate installation of utility services and attachment to foundations, other members, or other structures. Smaller drain holes 13 will provide an exit path for condensation or other moisture build up.

Figure 3:
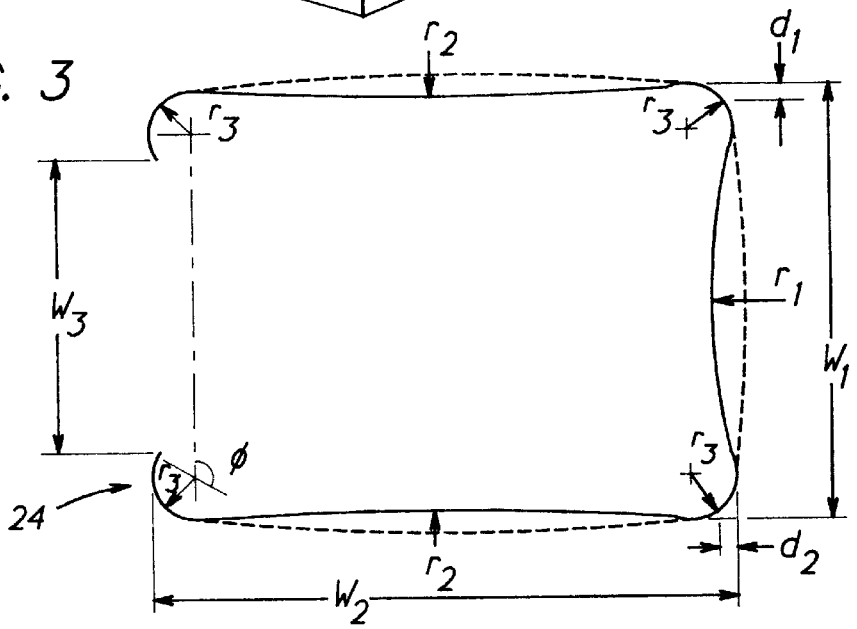
FIG. 3 is a cross section view of a smooth C-shaped channel member.

Referring to FIG. 3, a smooth C-channel 24 is shown with various dimensional parameters including $w_1$, $w_2$, $w_3$ (widths), $r_1$, $r_2$, $r_3$ (radii), $d_1$, $d_2$ (deflections), and Ø

(included angle). This is a preferred cross-sectional shape due to its high resistance to bending moments. These dimensional parameters would be determined by various design goals, taking into account the strength of the material, desired load capacity, and structural deflection analysis.

The width of the channels 16 may be from 1.5" up to any width required by architectural, structural, thermal, noise suppression, or any other design requirements.

Figure 4:
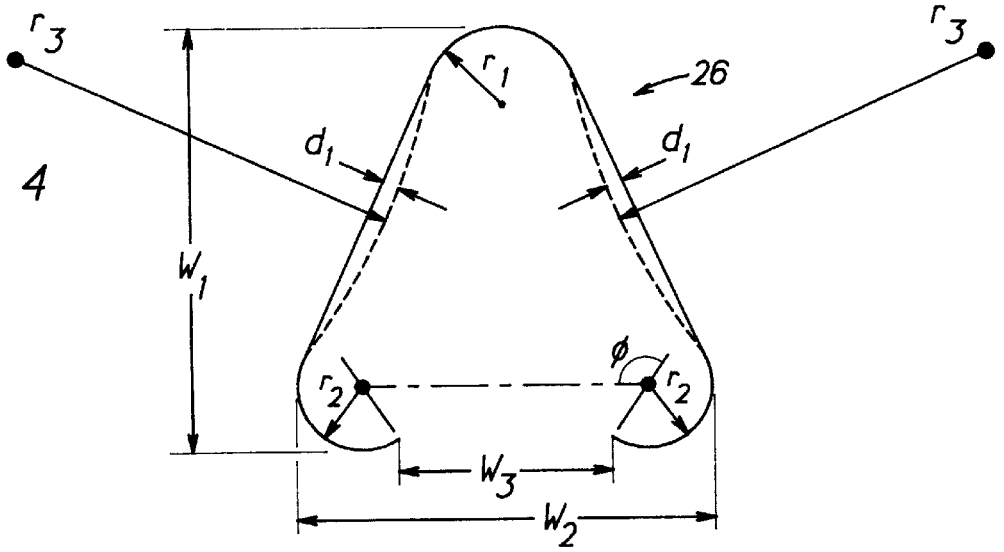
FIG. 4 is a cross section view of a smooth V-shaped channel member.

Referring to FIG. 4, a smooth V-channel 26 is shown with various dimensional parameters including $w_1$, $w_2$, $w_3$, $r_1$, $r_2$, $r_3$, $d_1$, and Ø.

Figure 2B:
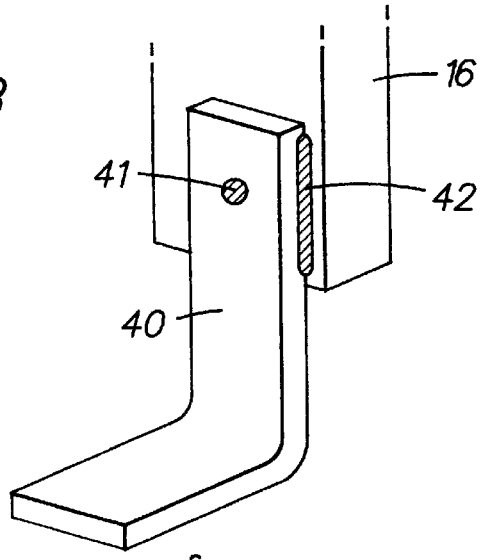
FIG. 2B is a perspective view of a channel member with the tab attached.

Referring to FIG. 2B, each channel 16 intended for use as a vertical member 31 (see FIG. 5) has a tab 40 attached to each end of the channel 16. The tab 40 is curved 90° and is attached by either a spot weld 41 or a seam weld 42. The spot weld 41 is the preferred embodiment.

Figure 5A:
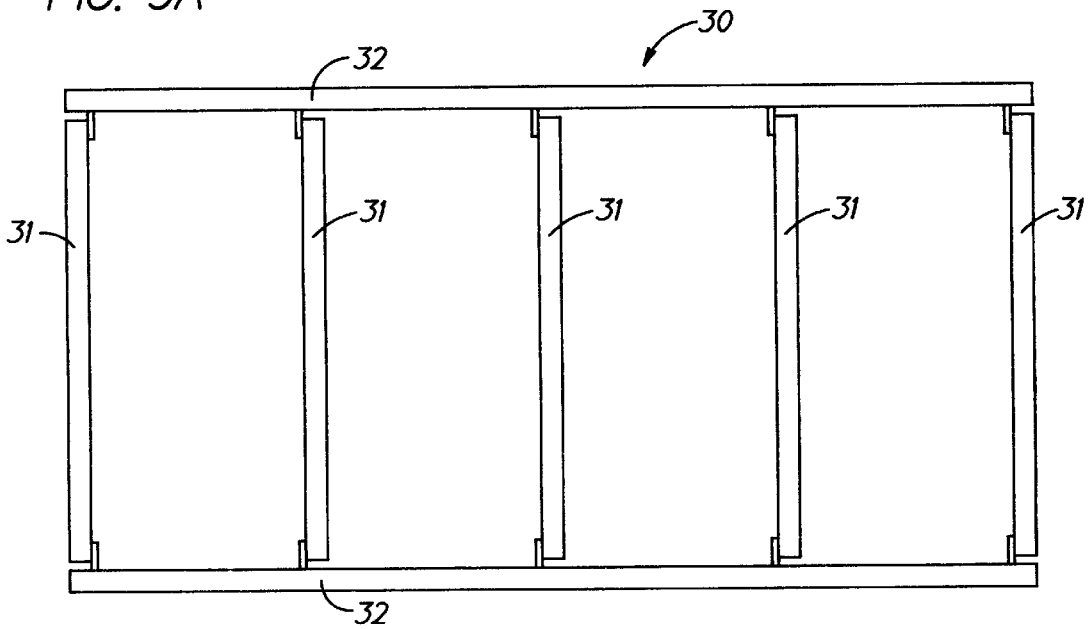
FIG. 5A is a side elevation view of a framing section.

Referring to FIGS. 1D & 5A, there are typically two different style channels 16 used in constructing a typical wall section 30. The horizontal members 32 are usually constructed from U-channels 22 and the vertical members 31 are constructed from smooth C-shaped channels 24. This difference lies in the anticipated structural loading for each channel 16. The vertical members 31 will carry compression and bending loads whereas the horizontal members 32 will carry mostly light tension loads. Thus the vertical members 31 must be designed to survive higher and more complex loading than the horizontal members 32.

Figure 5B:
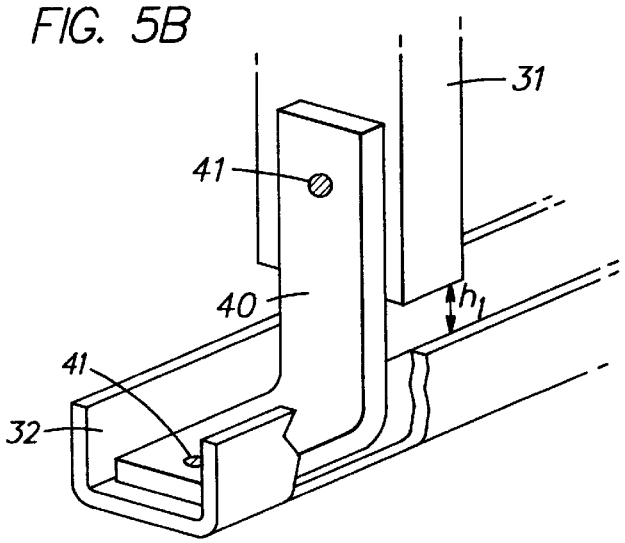
FIG. 5B is a perspective view of a tab connecting a vertical channel and a horizontal channel.
Figure 5C:
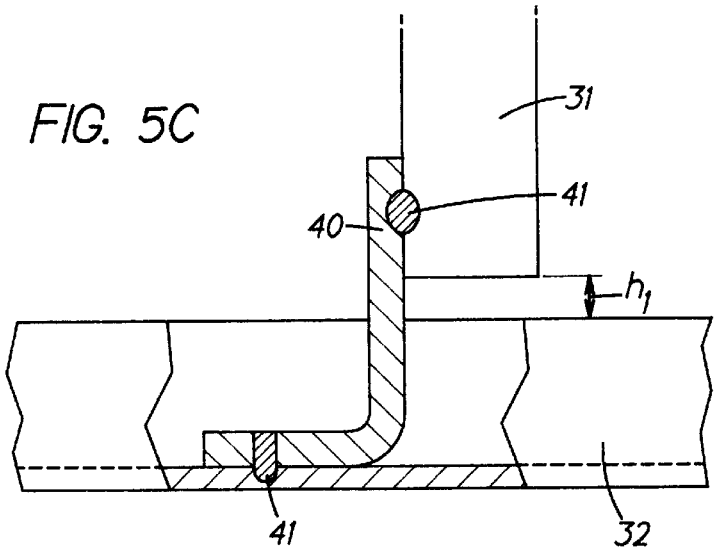
FIG. 5C is a side elevation view of a tab connecting a vertical channel and a horizontal channel.
Figure 5D:
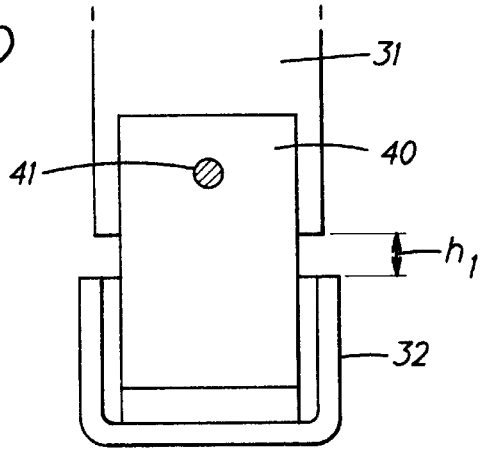
FIG. 5D is a front elevation view of a tab connecting a vertical channel and a horizontal channel.

Referring to FIGS. 5B, 5C & 5D, the vertical member 31, with its attached tab 40 is placed into its final position with the horizontal member 32. Another spot weld 41 is formed between the tab 40 and the horizontal member 32. Other attachment techniques may be used, for example crimping, pop-rivets, staples, or self-tapping screws. However none of these is as desirable as welding. Welding will survive bending and flexing longer than conventional mechanical attachments, and therefore is more adaptable for geographical areas with high earthquake risk.

It is critical to note that the tab 40 is dimensioned so that the vertical member 31 maintains a gap $h_1$ above the horizontal member 32. This gap $h_1$ is critical to this invention in that it allows the vertical members 31 to flex under load without transmitting high bending moments to the vertical members 32.

Referring to FIG. 5, the lower tab is designed to bear the full structural load of the vertical member into the base channel. A gap $h_1$ must be maintained between the vertical and horizontal members to allow for the vertical member to flex and sway from a non vertical position when subject to earthquake forces. If the gap $h_1$ is too small, then during an earthquake the vertical member will contact the base member, transmitting undesired bending moments into the vertical members, intimately causing the vertical members to structurally fail.

The upper tabs, or those tabs used on the top of vertical members are similarly designed to transmit any structural loads from the top horizontal channel into the vertical members. A similar gap $h_1$ is also maintained.

Referring again to FIG. 5A, the horizontal channels 32 and vertical channels 31 are framed into a dimensionally predetermined section 30 which may or may not contain framing for windows 43, doors 44, and other architectural features. The vertical channels 31 may be spaced horizontally on 16" or 20" centers, or other lateral spacing depending on the design requirements. Mounting brackets are incorporated in the panel preassembly in any areas framed for windows, doors, or other openings, to enable ready fastening of frames and sashes.

Once the section 30 has been completely framed, it may be optionally treated with paint, galvanizing, anodizing or other coating materials to protect the metal from natural elements.

Figure 6:
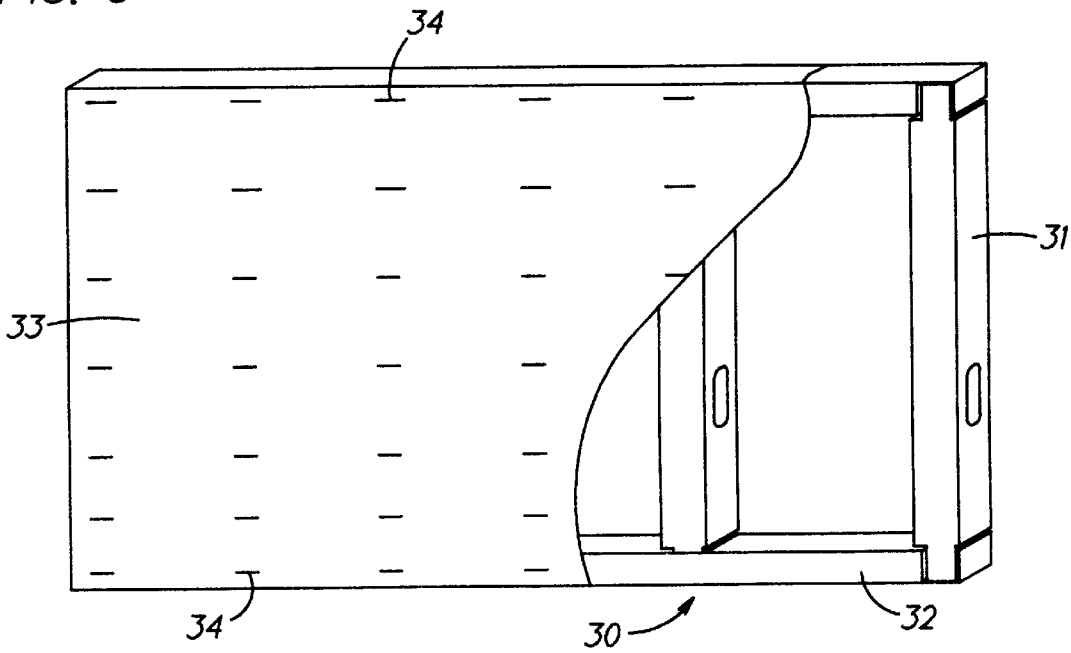
FIG. 6 is a cutaway view of framing section with an absorbent covering.

Referring to FIG. 6, after the metal section 30 has been treated, burlap 33 or other porous screening material is attached to the exterior side of the section 30 with staples 34, brads, or roofing nails. The covering may be burlap or other material, either typically an open mesh, close knit or similar underlayment which may be treated for proper adhesion for subsequent spray application. This underlayment may be of synthetic, organic or inorganic materials including metal strips, mesh or sheets, or a combination of these. Typical and best applications are where the covering material 33 is highly absorbent to the sprayed applied polymer. Burlap and other coarse weave materials have been found suitable.

Figure 7:
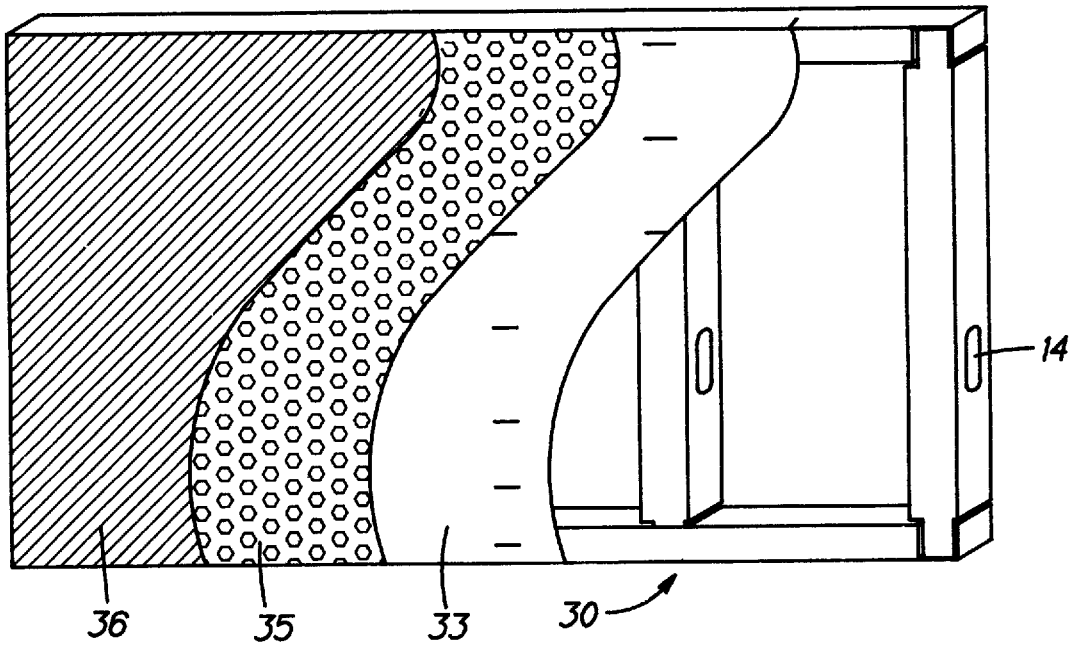
FIG. 7 is a cutaway view of framing section with an absorbent covering, expanded metal, and spray coating.

Referring to FIG. 7, next an optional layer of expanded metal 35 is attached to the section over the burlap 33 in a similar manner. The expanded metal 35 is applied when the intended finish will be stucco or other material which can be troweled onto the section at the job site.

The expanded metal 35 serves to enable better bonding of subsequently sprayed-on materials such as "shot-crete", or subsequent applications of clapboard, stucco or other veneers. Both the burlap 33 and the expanded metal 35 are fastened to the metal studs at regular intervals, including top and bottom U-channels. The spray coating 36 is permitted to be absorbed onto and through the burlap and adhere to the metal framing for further adhesion as it polymerizes. The fibers and burlap combination prevents running of the polymers, the latter which may be heated to reduce the viscosity, increase the absorbency with shortened pot life. Pot life with room temperature cure should not exceed 5 minutes. Typically, the material will set within a few seconds of application. The criteria is that the polymer should completely wet out the underlayment before gelling.

The burlap 33 and the expanded metal 35 may be nailed, screwed, welded or glued to the metal members 31 & 32. With this underlayment 33 & 35 in place, a rolled-on or sprayed-on pre-coating 36 is applied. The preferred method is stapling 34 of the burlap 33 and the expanded metal 35 to the framing section 30, then spray coat 36 the surface from the outside.

Figure 8:
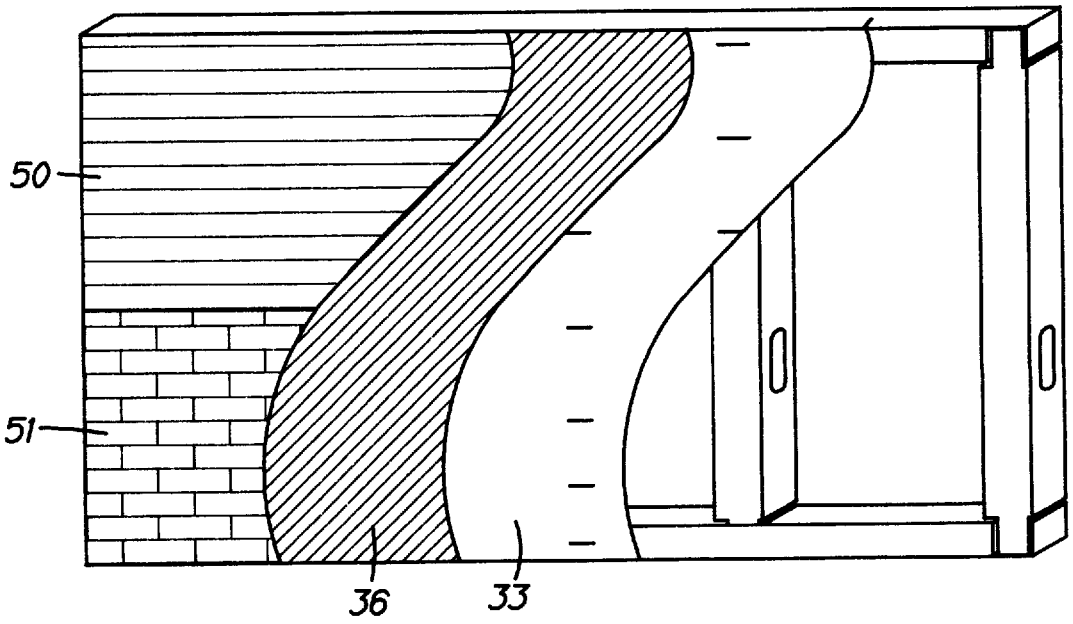
FIG. 8 is a cutaway view of framing section with an absorbent covering, expanded metal, spray coating, and clapboard and brick exterior finishes.

The burlap 33 would also be stretched to cover the length of a complete panel section 30 and fastened with staples 34 to the vertical 31 and horizontal 32 structural members which would also provide keying for subsequent coating applications. Referring to FIG. 8, typical overlap of material is 6".

The burlap and epoxy finish is removed by cutting away the material for openings to provide for windows and doors or other necessary openings are preferably may be cut after the sections have been assembled at the final job site.

The materials used in construction may also be treated with the appropriate chemicals so as to be resistant to vermin, termite, carpenter ants, or other undesirable or destructive life forms.

In addition to the pre treatment or mixed-in ingredients of its member and components, the structures may be finished corrosion-protected, erosion resistant, and its cladding and coatings be fire-retardant for proofed, as well as mold and fungi resistant.

Referring to FIG. 7, a spray coating 36 is uniformly applied to the expanded metal 35 and burlap 33. It is intended that the spray coating will be substantially deposited on the burlap 33, with a build up thicknesses from less than 1/128" to typically 3/32", controllable by the operator. The spray coating is a multi-component, semi or other polymeric chemicals with chop strand glass fibers or others to enhance the structural strength and to provide a nailable substructural surface for additional coatings, panels or coverings. With multi component thermoset resins, an accelerant may be used to promote rapid hardening. The ingredients preferred would be the non-solvent, non diluted types and fast-setting without running.

Typical materials for the spray coating 36 may be epoxy resins such as Shell Oil Co.s EPON™ 826 or 828 inxed with a cycloaliphatic hardener such as n-Amino Ethyl Piperizine (also known as AEP™) as manufactured by Jefferson Chemical Co., metered at a ratio of slightly less than that stoichiometry (to enhance extreme low temperature flexibility) of 20 parts per hundred by weight (phr) of hardener to 100 phr of the resin as adjusted to the mixing temperatures from the epoxy equivalents at 20 degrees centigrade. Small amounts of water in quantities of approximately 1 phr also tend to shorten the pot life and enhance mechanical properties.

Another spray coating 36 may be liquid polyester resin mixed such as Alpha Owens Corning #F11-2001 mixed with 1–4 phr of 9% active Methyl-Ethyl-Ketone Peroxide manufactured by BIC Chemie under the code "AKZO™". Additionally, smaller quantities of 12% Cobalt Napthanate (about 0.1–0.3 phr depending on other partly reactive additives such as alumina tri hydrate or other chemicals including water). This latter formulation is less expensive, but the materials have lesser bonding and mechanical strengths than the more expensive epoxy resins.

When the spray coating 36 has been applied and set, the structural sections may be prewired, and plumbing or other auxiliaries installed in the section 30, making use of the utility holes 14 in the vertical channels 31.

After the utilities are installed in the wall cavities, a 'rigid' foam single or multi-component chemical mixture, such as urethane, polyurethane, or polyol at a typical density of 2 lbs/cu. ft. may be spray applied to the wall cavities which will securely fasten the utility services, provide additional mechanical strength, sound proofing, and thermal insulation to the extent design, local, economic and environmental requirements call for. The cavities may be left void where necessary or so desired because of cost considerations.

Typically floor, wall, interior partition, and roof sections would be factory assembled and transported to the job site in larger units for final installation and finish.

Referring to FIG. 8, secondary or final exterior coverings may be metal or plastic clapboard 50, sidings, brick 51 or other veneered finishes including tiled or spray applied stucco or pigmented luster, plaster, cementoid, foamed to enhance insulating value or similar finishes. Locally available materials such as plaster, cement, clay, gypsum, hemp and other binders may be used where minimum costs are of the essence.

The interior side of the structural sections may be covered initially in the same fashion as the exterior side. First burlap 33 would be stapled 34 to the framing section 30 and then covered with a spray coating 36. This forms a substrate which may either be finish painted or have other finish materials such as wood nailed or glued to it. The interior side of the structural section may also be covered with particle board, rigid sheets or other organic or inorganic in situ applied materials which could be straight or curved as design dictates. Normally it is desirable to fabricate the interior walls in a factory setting.

On top of the interior/exterior nailable substrate, if 'rustic' finish is not desired, a plaster or cementite finish would complete the aesthetic requirements for a finished superior quality building.

Provisions may be made in the design for louvers, vents, built-in structures like beds, tables, shelving, sun/wind/rain shields, water storage tanks and other custom features.

Buildings constructed with this invention may be suitable for below ground, above ground, and set in the side of a slope installations. In FIG. 12, separate embodiments disclose design considerations for construction on piers and or stilts for elevated occupancy.

Translucent sections may fabricated by using an open mesh matting to cover the assembled section frame and then impregnating it with a polymer to achieve the desired strength.

The described process and apparatus are suitable and economical for low cost home construction as well as luxury abodes as well as other kinds of buildings such as multi-family or commercial/industrial. Structures may also be furnished to buyers who may wish to perform the on site assembly on their own.

This novel process allows for variations in design so as to accommodate the requirements of varied climates from the Arctic regions to the tropics.

It is understood that the above description and drawings are illustrative of the present invention and details contained therein are not to be construed as limitations on the present invention. Variations in materials, components, structural configurations, and the order of certain steps and the like may be made without departing from the scope of the present invention as defined in the following claims.

What is claimed is:

1. An all climate flexible building construction process comprising:

straightening sheet metal from a coil;

cutting said sheet metal into a plurality of strips of a predetermined width;

recoiling at least one of said plurality of strips into an individual coil;

straightening said at least one of said plurality of strips from said individual coil;

fabricating holes of various shapes and dimensions into said at least one of said plurality of strips;

roll forming said at least one of said plurality of strips into a desired cross-sectional channel;

cutting said channel into predetermined lengths;

attaching a first end of a curved tab to a predetermined location on at least one of said lengths;

positioning said at least one of said lengths and an other length into a framework whereby a second end of said curved tab is placed in close proximity to said an other length;

attaching said second end of said curved tab to said an other length to fix said lengths in relation to each other in said framework;

applying a protective coating on said framework;

attaching an absorbent covering material to one side of the framework whereby a wall void is created between adjacent said lengths in said framework;

spraying a polymer mixture onto the absorbent material;

installing utility services into the wall void of the framework;

applying a spray foam to the wall voids;

erecting and assembling multiple sections into a predetermined structure;

removing the absorbent covering material and polymer mixture from certain predetermined wall voids of said framework for doors, windows and other passageways;

applying finishing materials to the exterior of the structure;

applying finishing materials to the interior of the structure;

wherein in the above process renders a structure which will endure the natural elements in a far superior manner than conventional construction techniques.

2. The process according to claim 1 in which the curved tabs are attached using a spot weld so as to maintain a predetermined gap between said at least one of said lengths and said an other length.

3. The process according to claim 2 in which the sheet metal is steel.

4. The process according to claim 2 in which the sheet metal is aluminum.

5. The process according to claim 2 in which the polymer mixture is an epoxy resin mixed with a cycloaliphatic hardener metered at a ratio of slightly less than that stoichiometry of 20 parts per hundred by weight (phr) of hardener to 100 phr of the resin as adjusted to the mixing temperatures from the epoxy equivalents at 20 degrees centigrade.

6. The process according to claim 1 in which synthetic fibers are fed into the polymer mixture as it is spray applied.

7. The process according to claim 6 in which the synthetic fibers are chopped strand glass fibers.

8. The process according to claim 7 in which at least one of a fire retardant chemical, an insecticide, a termite pesticide, and a vermin repellent are added to the polymer mixture.

9. The process according to claim 8 in which the exterior finish material is at least one of aluminum, vinyl, clapboard, wood, stucco, brick, and masonry.

10. The process according to claim 9 in which the interior finish materials are applied over a substrate of an absorbent covering material to which a spray polymer mixture has been applied.

11. The process according to claim 10 in which the spray foam applied to the wall voids is polypropylene.

12. The process according to claim 2 in which the polymer mixture is a liquid polyester resin mixed with 1–4 phr of 9% active Methyl-Ethyl-Ketone Peroxide.

13. The process according to claim 12 in which synthetic fibers are fed into the polymer mixture as it is spray applied.

14. The process according to claim 13 in which the synthetic fibers are chopped strand glass fibers.

15. The process according to claim 14 in which at least one of a fire retardant chemical, an insecticide, a termite pesticide, and a vermin repellent are added to the polymer mixture.

16. The process according to claim 15 in which the exterior finish material is at least one of aluminum, vinyl, clapboard, wood, stucco, brick, and masonry.

17. The process according to claim 16 in which the interior finish materials are applied over a substrate of an absorbent covering material to which a spray polymer mixture has been applied.

18. The process according to claim 17 in which the spray foam applied to the wall voids is polypropylene.

* * * * *